United States Patent [19]

Ekbom

[11] Patent Number: 4,820,484

[45] Date of Patent: Apr. 11, 1989

[54] METHOD IN PRODUCING A MOLDING OF AN IRON ALLOY

[75] Inventor: Ragnar Ekbom, Finspang, Sweden

[73] Assignee: Asea Stal AB, Finspang, Sweden

[21] Appl. No.: 929,105

[22] PCT Filed: Feb. 19, 1986

[86] PCT No.: PCT/SE86/00070

§ 371 Date: Oct. 2, 1986

§ 102(e) Date: Oct. 2, 1986

[87] PCT Pub. No.: WO86/04841

PCT Pub. Date: Aug. 28, 1986

[30] Foreign Application Priority Data

Feb. 19, 1985 [SE] Sweden ..... 8500773

[51] Int. Cl.[4] ..... C22F 1/00

[52] U.S. Cl. ..... 419/49; 419/53; 419/54; 75/246

[58] Field of Search ..... 419/49, 53, 54; 75/246

[56] References Cited

U.S. PATENT DOCUMENTS

| | | | |
|---|---|---|---|
| 3,522,020 | 7/1970 | Parikh | 419/49 |
| 3,772,009 | 11/1973 | Isaksson | 419/49 |
| 4,609,526 | 9/1986 | Haswell et al. | 419/49 |
| 4,615,735 | 10/1986 | Ping | 419/53 |

FOREIGN PATENT DOCUMENTS

| | | |
|---|---|---|
| 87 2635 | 6/1942 | France . |
| 52-18412 | 12/1977 | Japan . |
| 212325 | 4/1967 | Sweden . |
| 218004 | 1/1968 | Sweden . |
| 397205 | 10/1977 | Sweden . |
| 430904 | 12/1983 | Sweden . |
| 1181552 | 2/1970 | United Kingdom . |
| 1266894 | 9/1974 | United Kingdom . |

OTHER PUBLICATIONS

S. Friborg: HIP to Near Net Shape, Scand J. Metallurgy 11(1982), s 223–225.

MNC Handbok nr 3, 1978, Gjutlegeringar, s 106.

E. Houdremont & R. Wasmuht: Non-Rusting & Heat Resisting 34% Chromium Alloy Cast Irons Metals & Alloys, Feb. 1933, s 13–17.

*Primary Examiner*—Stephen J. Lechert, Jr.

*Attorney, Agent, or Firm*—Merchant, Gould, Smith, Edell, Welter & Schmidt

[57] ABSTRACT

Method in producing a molding of an iron alloy, wherein the molding is produced by hot isostat pressing of a prealloyed powder comprising 0.5 to 2.8% coal by weight, 24 to 35% chromium by weight, from effective amount to 2% silicon by weight, from effective amount to 1.5% manganese by weight, 0 to 2.3% nickel weight, and 0 to 3.0% molybdenum by weight, and the residue iron.

6 Claims, No Drawings

METHOD IN PRODUCING A MOLDING OF AN IRON ALLOY

The present invention relates to a method in producing a molding of an iron alloy.

It is previously known to produce moldings of such an iron alloy by conventional casting, i.e. the molten alloy is poured into a mold. The moldings produced in this manner present good properties with regard to resistance to wear, workability, resistance to erosion and sliding.

The invention is based on the knowledge that these properties can be considerably improved, that the molding can be made more homogeneous than in case it is made of a cast material, and that there can be imparted to the molding, particularly as far as the ductility is concerned, unique properties if it is produced by hot isostat pressing of a prealloyed powder according to the characteristics of claim 1.

In order to explain the invention in more detail selected illustrative embodiments thereof will be described in the following.

In TABLE I below, the composition of alloys are listed which are suitable for working the method of the invention, the contents of the constituents of the alloys being given in % by weight.

TABLE I

| | | Alloy 1 | Alloy 2 | Alloy 3 | Alloy 4 | Alloy 5 | Alloy 6 | Alloy 7 |
|---|---|---|---|---|---|---|---|---|
| C % | min | 0.5 | 0.9 | 1.9 | 2.4 | 0.9 | 1.9 | 1.3 |
| | max | 0.7 | 1.1 | 2.1 | 2.8 | 1.1 | 2.1 | 1.7 |
| Si % | min | 0.5 | 0.5 | 0.5 | 0.5 | 0.5 | 0.5 | 0.5 |
| | max | 1.5 | 1.5 | 1.5 | 1.5 | 1.5 | 1.5 | 2.0 |
| Mn % | min | 0.3 | 0.3 | 0.3 | 0.5 | 0.3 | 0.3 | 0.5 |
| | max | 0.7 | 0.7 | 0.7 | 1.2 | 0.7 | 0.7 | 1.5 |
| Cr % | min | 25.5 | 25.5 | 25.5 | 24.0 | 32.5 | 32.5 | 24.0 |
| | max | 26.5 | 26.5 | 26.5 | 28.0 | 33.5 | 33.5 | 28.0 |
| Ni % | min | — | — | — | — | — | — | 1.7 |
| | max | — | — | — | — | — | — | 2.3 |
| Mo % | min | — | — | — | — | — | — | 2.0 |
| | max | — | — | — | — | — | — | 3.0 |
| Fe | | res. | res. | res. | res. | res. | res. | res. |

The constituents of the alloy are carefully mixed in a charge from which there is produced by a known method a powder having a grain size ranging between 0.1 and 1000 μm.

The powder thus prealloyed is introduced into a mold for hot isostat pressing having a configuration to be imparted to the related molding, the air then being evacuated from the mold. The evacuated mold is inserted into a hot isostat press wherein the pressing is performed by means of argon at a pressure ranging between 100 and 150 MPa and at a temperature ranging between 1230° and 1270° C. The period during which the pressure is to be maintained at said temperature will be dependent on the size of the molding. The molding must be hot throughout, and for solid moldings the period involved may range from 1 to 3 hours. When the pressing has been completed, the molding is allowed to cool to room temperature while it is still maintained in the press, the mold then being removed from the press to be exposed to heat treatment in an electric oven. This heat treatment takes place at a temperature ranging between 1075° and 1125° C. for a period ranging from 1 to 5 hours depending on the size and character of the molding.

Moldings which have been produced by the method of the invention using alloyed powder of one of the compositions listed above in TABLE I are superior to moldings produced by conventional casting of identical or similar alloys, as far as the quality is concerned, which would be due to the high pressing temperature providing growth of carbides during the hot isostat pressing. Moldings which have been produced by the method of the invention have been found to have extraordinarily good properties with regard to resistance to wear, ductility, workability, resistance to erosion and sliding, which to a considerable extent are superior to corresponding properties of cast moldings, particularly as far as the ductility is concerned. Contrary to sintered moldings the moldings produced by hot isostat pressing of prealloyed powder material by the method of the invention have a completely dense structure.

In order to obtain resistance to corrosion the alloy can contain from effective amount to 2.3 % nickel by weight and from effective amount to 3.0 % molybdenum by weight. The alloy 7 is such an alloy which provides great resistance to corrosion.

I claim:

1. Method in producing a shaped molding of an iron alloy, characterized in that the molding is produced by hot isostatic pressing of a prealloyed powder comprising 0.5 to 2.8 % coal by weight, 24 to 35 % chromium by weight, from effective amount to 2 % silicon by weight, from effective amount to 1.5 % manganese by weight, 0 to 2.3 % nickel by weight, and 0 to 3.0 % molybdenum by weight, and the residue iron.

2. Method as claimed in claim 1, characterized in that the hot isostatic pressing is performed at a pressure ranging between 100 and 150 MPa, and at a temperature ranging between 1230° and 1270° C.

3. Method as claimed in claim 2, characterized in that the molding produced after pressing is allowed to cool to room temperature in the press and then, after removal from the press, is exposed to heat treatment at a temperature ranging from 1075° to 1125° C.

4. Method as claimed in claim 3, characterized in that the heat treatment is performed over a period ranging from 1 to 5 hours.

5. A method of producing a shaped molding including the steps of:

(a) producing the molding, in a press, from hot isostatic pressing of a prealloyed powder comprising, by weight, 0.5–2.8% coal, 24–35% chromium, from an effective amount to 2% silicon by weight, from an effective amount to 1.5% manganese by weight, from 0 to 2.3% nickel by weight, and from 0 to 3.0% molybdenum by weight, and the residue iron; said hot isostatic pressing being at a pressure of between 100 and 150 MPa and at a temperature between 1230° and 1270° C.;

(b) cooling the molding from step (a), in the press, to room temperature;

(c) removing the molding from the press; and, (d) heat treating the molding at a temperature between 1075° and 1125° C. for at least 1 hour.

6. The method according to claim 5 wherein said step of heat treating is conducted over a period ranging from 1–5 hours.

* * * * *